US008955195B2

(12) United States Patent
Chang et al.

(10) Patent No.: US 8,955,195 B2
(45) Date of Patent: Feb. 17, 2015

(54) CLAMPING-SLIDING ASSEMBLY FOR A SINGLE-TRACK-SUSPENSION SLIDING DOOR

(71) Applicant: Door & Window Hardware Co., Taichung (TW)

(72) Inventors: Wei-Hung Chang, Taichung (TW); Sung-Hui Lin, Taichung (TW)

(73) Assignee: Door & Window Hardware Co., Taichung (TW)

( * ) Notice: Subject to any disclaimer, the term of this patent is extended or adjusted under 35 U.S.C. 154(b) by 3 days.

(21) Appl. No.: 13/684,544

(22) Filed: Nov. 25, 2012

(65) Prior Publication Data

US 2014/0143980 A1 May 29, 2014

(51) Int. Cl.
*E05D 15/00* (2006.01)
*E05D 15/06* (2006.01)

(52) U.S. Cl.
CPC ..... *E05D 15/0639* (2013.01)
USPC ..... 16/91; 16/105

(58) Field of Classification Search
CPC ..... E05Y 2900/132; E05Y 2201/642; E05Y 2201/64; E05D 15/0639; E05D 15/0634; E05D 15/063; E05D 15/0621
USPC ..... 16/87 R–107; 248/298.1, 317, 323, 327, 248/342; 49/409, 425
See application file for complete search history.

(56) References Cited

U.S. PATENT DOCUMENTS

| | | | | | |
|---|---|---|---|---|---|
| 927,272 | A * | 7/1909 | Ohl | 16/105 |
| 1,086,531 | A * | 2/1914 | Hurd | 49/100 |
| 1,192,966 | A * | 8/1916 | Willard | 16/105 |
| 1,568,270 | A * | 1/1926 | Cross | 16/105 |
| 2,574,496 | A * | 11/1951 | Pomeroy et al. | 49/409 |
| 2,627,633 | A * | 2/1953 | Shectman | 52/801.1 |
| 2,697,848 | A * | 12/1954 | Tompkins | 16/105 |
| 2,888,708 | A * | 6/1959 | Seidner | 16/105 |
| 2,940,112 | A * | 6/1960 | Riser | 16/105 |
| 3,057,005 | A * | 10/1962 | Dishaw | 16/105 |
| 3,152,354 | A * | 10/1964 | Diack | 16/94 R |
| 3,283,444 | A * | 11/1966 | Andres | 49/420 |
| 3,959,849 | A * | 6/1976 | Marquardt | 16/105 |
| 4,478,006 | A * | 10/1984 | Johnson, Jr. | 49/410 |
| 5,671,502 | A * | 9/1997 | Ezman | 16/105 |
| 6,021,547 | A * | 2/2000 | Stagoll | 16/105 |
| 6,698,138 | B1 * | 3/2004 | Lin | 49/409 |
| 7,647,729 | B2 * | 1/2010 | Polus | 49/425 |
| 8,046,872 | B2 * | 11/2011 | Burgess et al. | 16/97 |
| 8,381,354 | B2 * | 2/2013 | Haab et al. | 16/91 |
| 2007/0261198 | A1 * | 11/2007 | Vogler | 16/87 R |
| 2010/0101150 | A1 * | 4/2010 | Huang | 49/409 |

* cited by examiner

*Primary Examiner* — Victor Batson
*Assistant Examiner* — Matthew Sullivan
(74) *Attorney, Agent, or Firm* — Pai Patent & Trademark Law Firm; Chao-Chang David Pai

(57) ABSTRACT

A clamping-sliding assembly for a single-track-suspension sliding door has a body and a roller mount. The body has a clamping recess transversally formed through the body, a connecting recess longitudinally formed through the body and communicating with the clamping recess, a connecting mount formed on and protruding in the connecting recess with an adjusting hole and an adjusting bolt rotatably connected to the connecting mount in the adjusting hole. The roller mount is movably mounted in the connecting recess, abuts the adjusting bolt and has at least one roller rotatably connected to the roller mount and an abutting face formed in the roller mount and abutting the adjusting bolt to adjust a height of the roller mount relative to the body.

16 Claims, 9 Drawing Sheets

CLAMPING-SLIDING ASSEMBLY FOR A SINGLE-TRACK-SUSPENSION SLIDING DOOR

BACKGROUND OF THE INVENTION

1. Field of the Invention

The present invention relates to a clamping-sliding assembly, and more particularly relates to a clamping-sliding assembly for a single-track-suspension sliding door to adjust the height of the sliding door easily and conveniently and to prevent the sliding door from turning over a track.

2. Description of Related Art

With reference to FIGS. 6 to 8, a conventional clamping-sliding assembly 60 for a single-track suspension sliding door is movably mounted in a sliding recess of a track 61 and has a body 631, multiple clamping blocks 632 and a roller mount 633. The body 631 is elongated and has an inner side and an outer side. The clamping blocks 632 are respectively mounted on the sides of the body 631 to form a clamping recess 634 between the clamping blocks 632. The clamping recess 634 is used to clamp a glass door 70. In addition, each one of the clamping blocks 632 that are mounted on the outer side of the body 631 has a top face, a bottom face, a threaded hole and a safe screw 636. The threaded hole is formed through the top face and the bottom face of the clamping block 632. The safe screw 636 is mounted in the threaded hole of the clamping block 632 from an upward or a downward direction and selectively extends out of the top face or the bottom face of the clamping block 632.

The roller mount 633 is connected to the inner side of the body 631 between two of the clamping blocks 632 by an adjusting bolt 637, is movably mounted in the track 61 and has an inner side, a bottom and at least one roller 635. The at least one roller 635 is rotatably mounted on the inner side of the roller mount 633 near the bottom of the roller mount 633 and is slidably mounted in the sliding recess 611 of the track 61. Furthermore, when the adjusting bolt 637 is loosen, the roller mount 633 can be moved upwardly or downwardly relative to the body 631.

With referenced to FIG. 8, in assembly, the conventional clamping-sliding assembly 60 is clamped on a top of a glass door 70 and then the at least one roller 635 is mounted in the sliding recess 611 of the track 61. The height of the glass door 70 can be adjusted by loosening the adjusting bolt 637 to enable the roller mount 633 to move upwardly or downwardly relative to the body 631. When the adjusting bolt 637 is loosen to adjust the height of the glass door 70, the whole weight of the glass door 70 will centralized on the adjusting bolt 637 and this is inconvenient in assemble. After adjusting the height of the glass door 70, the safe screws 636 are rotated relative to the corresponding clamping blocks 632 and extend out of the top faces of the corresponding clamping blocks 632 to prevent the glass door 70 from turning over.

However, when the conventional clamping-sliding assembly 60 is assembled, the glass door 70 is connected to the track 61 via the conventional clamping-sliding assembly 60 and the safe screws 636 are needed to rotate. Then, the glass door 70 can be assembled with the conventional clamping-sliding assembly 60 and the track 61. Furthermore, the adjusting bolt 637 and the safe screws 636 have to be rotated to respectively adjust the height of the glass door 70 and to prevent the glass door 70 from turning over, and this is inconvenient in use.

Therefore, the invention provides a clamping-sliding assembly for a sliding door to mitigate or obviate the aforementioned problems.

SUMMARY OF THE INVENTION

The main objective of the present invention is to provide a clamping-sliding assembly for a single-track-suspension sliding door to adjust the height of the sliding door and to prevent the sliding door from turning over easily and conveniently.

The clamping-sliding assembly for a single-track-suspension sliding door in accordance with the present invention has a body and a roller mount. The body has a clamping recess transversally formed through the body, a connecting recess longitudinally formed through the body and communicating with the clamping recess, a connecting mount formed on and protruding in the connecting recess with an adjusting hole and an adjusting bolt rotatably connected to the connecting mount in the adjusting hole. The roller mount is movably mounted in the connecting recess, abuts the adjusting bolt and has at least one roller rotatably connected to the roller mount and an abutting face formed in the roller mount and abutting the adjusting bolt to adjust a height of the roller mount relative to the body.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
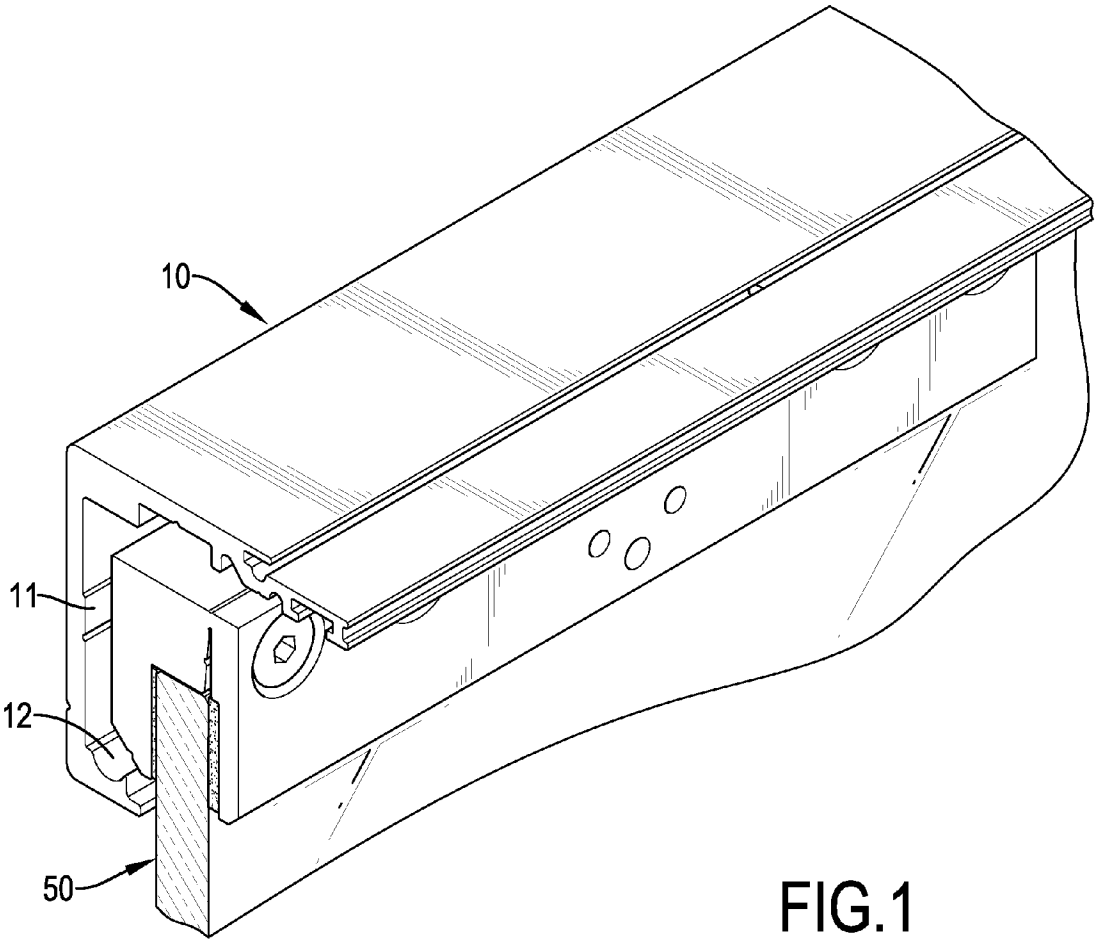
FIG. 1 is a perspective view of a clamping-sliding assembly in accordance with the present invention mounted on a single-track-suspension sliding door.

With reference to FIGS. 1 to 4, a clamping-sliding assembly 30 for a single-track-suspension sliding door in accordance with the present invention is mounted between a track 10 and a glass door 50 to prevent the glass door 50 from turning over the track 10 and to adjust a height of the glass door 50 relative to the track 10. The track 10 may be L-shaped in cross section, is mounted securely on a wall and has an inner side, an inner top surface, a bottom, an opening 11 and a sliding recess 12. The opening 11 is formed through the inner side of the track 10. The sliding recess 12 is formed in the bottom of the track 10, communicates with the opening 11 and has a bottom face and a depth (D). In addition, a distance between the inner top surface of the track 10 and the bottom surface of the sliding recess 12 is defined as a first height (H).

The clamping-sliding assembly 30 is movably mounted in the sliding recess 12 of the track 10, is clamped on the glass door 50 and has a body 31 and a roller mount 33.

Figure 2:
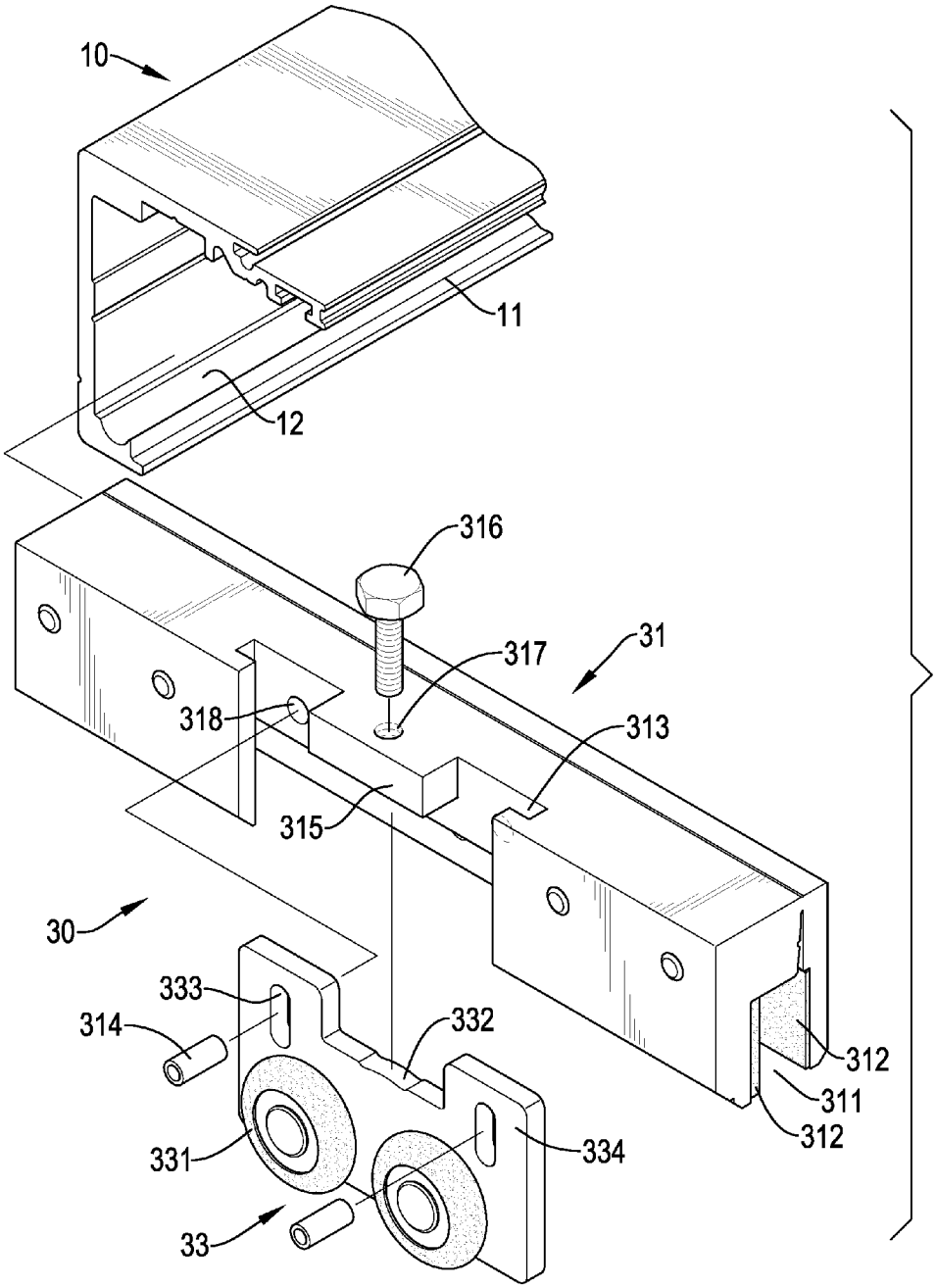
FIG. 2 is an exploded perspective view of the clamping-sliding assembly in FIG. 1.

The body 31 may be rectangular U-shaped in cross section and has a bottom, a top, an inner side, a middle, a clamping recess 311, two inner mats 312, a connecting recess 313, at least one holding hole 318, at least one limiting pin 314, a connecting mount 315 and an adjusting bolt 316. The clamping recess 311 is transversally formed through the bottom of the body 31 and is used to clamp on a top of the glass door 50. The inner mats 312 are mounted in the clamping recess 311 and abut the sides of the glass door 50. The connecting recess 313 is longitudinally formed through the top and the inner side of the body 31 at the middle of the body 31 beside the clamping recess 311, communicates with the clamping recess 311 and has an inner opening formed through the inner side of the body 31 as shown in FIG. 2.

The at least one holding hole 318 is transversally formed in the body 31 at the connecting recess 313. The at least one limiting pin 314 is mounted securely in the at least one holding hole 318 at the connecting recess 313 near the top of the body 31. The connecting mount 315 may be rectangular, is formed on and protrudes in the connecting recess 313 at the top of the body 31 to extend inwardly to the inner opening of the connecting recess 313 and has an adjusting hole 317 longitudinally formed through the connecting mount 315 and communicating with the connecting recess 313. Additionally, the connecting mount 315 is formed on and protrudes in the connecting recess 313 at a middle of the connecting recess 313 to form two upper openings at the top of the body 31 beside the connecting mount 315. The adjusting bolt 316 is rotatably connected to the connecting mount 315 in the adjusting hole 317 and has a top end, a bottom end and a length. The top end of the adjusting bolt 316 extends out of the connecting mount 315 above the top of the body 31. The bottom end of the adjusting bolt 316 extends out of the connecting mount 315 and extends in the connecting recess 313. The length of the adjusting bolt 316 is defined as a second height (B).

The roller mount 33 is movably mounted in the connecting recess 313 of the body 31 at the inner side, abuts the adjusting bolt 316 and has a top, a bottom, a middle, an inner side, an outer side, at least one roller 331, an abutting face 332 and at least one elongated hole 333. The outer side of the roller mount 33 faces the track 10. The at least one roller 331 is rotatably connected to the outer side of the roller mount 33 near the bottom of the roller mount 33 to extend out of the inner side of the body 31 via the inner opening of the connecting recess 313, is rotatably mounted in the sliding recess 12 of the track 10 and each one of the at least one roller 331 has a bottom face. Preferably, the roller mount 33 has two rollers 331 rotatably connected to the outer side of the roller mount 33 near the bottom of the roller mount 33 and rotatably mounted in the sliding recess 12 of the track 10.

The abutting face 332 is formed in the top of the roller mount 33 at the middle of the roller mount 33 and abuts the bottom end of the adjusting bolt 316. Furthermore, with reference to FIG. 2, the roller mount 33 has two guiding tabs 334 formed on and protruding upwardly from the top of the roller mount 33 beside the abutting face 332 and respectively mounted in the upper openings to prevent the roller mount 33 from tilting relative to the body 31. When adjusting bolt 316 is rotated to move relative to the body 31, the roller mount 33 is moved relative to the body 31 by the adjusting bolt 316 pushing against the abutting face 332 of the roller mount 33 and this can be used to adjust the height of the body 31 relative to the roller mount 33. Furthermore, a distance between the abutting face 332 and the bottom face of the at least one roller 331 is defined as a third height (A). The at least one elongated hole 333 is formed through the sides of the roller mount 33 near the top and is mounted around the at least one limiting pin 314 to prevent the roller mount 33 separating from the body 31 when the roller mount 33 is mounted in the sliding recess 12 of the track 10. Preferably, the at least one elongated hole 333 of the roller mount 33 is formed through one of the guiding tabs of the roller mount 33.

In addition, a distance between the top end of the adjusting bolt 316 and the inner top surface of the track 10 is defined as a movable height (d) and is a fixed value when the clamping-sliding assembly 30 is mounted between the glass door 50 and the track 10, and the movable height (d) is shorter than the depth (D) of the sliding recess 12. Furthermore, a distance between a highest point of the movable height (d) of the adjusting bolt 316 and the bottom face of the at least one roller 331 can be also defined as the first height (H), and a depth of the at least one roller 331 that is mounted in the sliding recess 12 is same as the depth (D) of the sliding recess 12.

Figure 3:
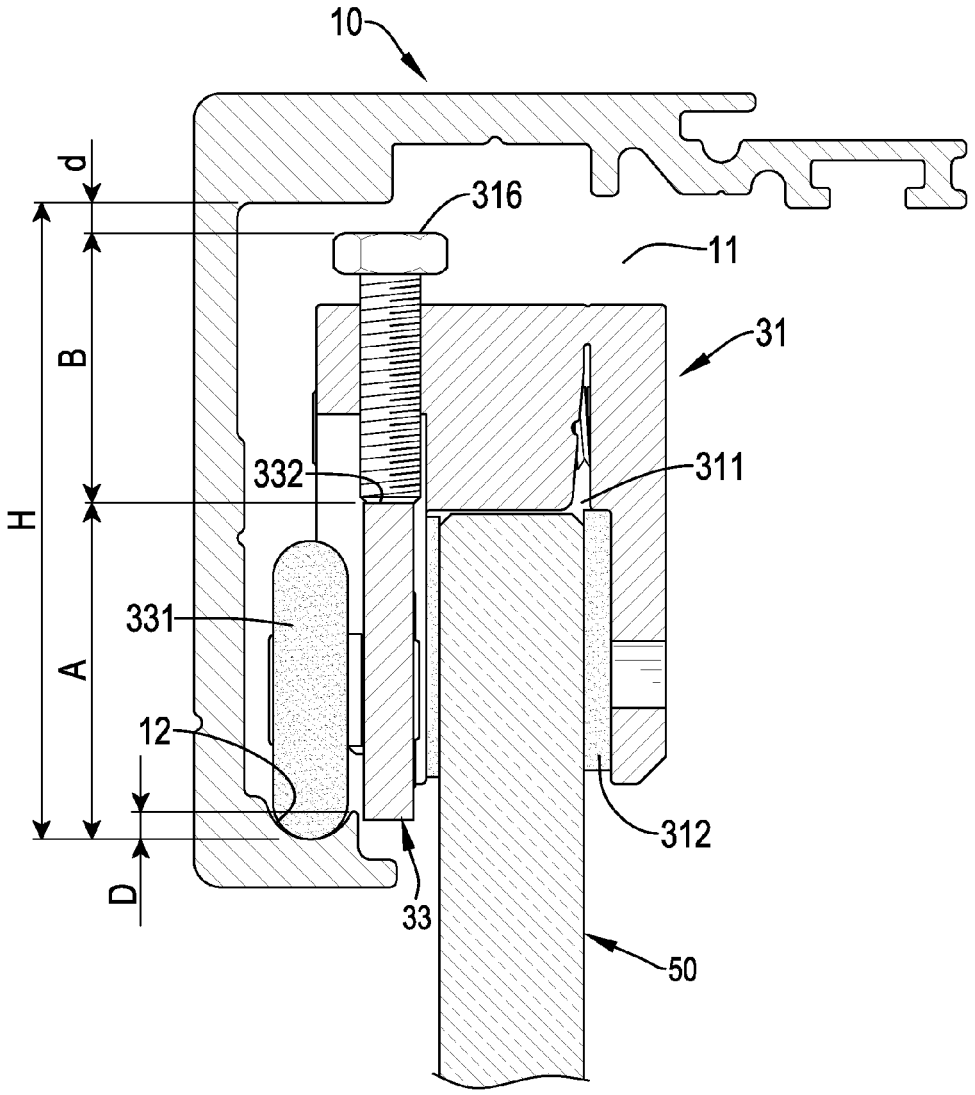
FIG. 3 is a side view in partial section of the clamping-sliding assembly in FIG. 1.

With reference to FIG. 3, in order to avoid the adjusting blot 316 to interfere with the inner top surface of the track 10 during an assembling process, the height of the adjusting blot 316 (the second height B) is shorter than a distance that is formed by the first height (H) minus the third height (A) (that is $B<H-A$). Therefore, if the size of the track 10 is changed with different first height (H), the adjusting bolt 316 of the body 31 may be changed with a one with different second height (B) to prevent the adjusting blot 316 from interfering with the inner top surface of the track 10 during the assembling process.

Additionally, in order to prevent the clamping-sliding assembly 30 from turning over the track 10, the height of the adjusting bolt 316 (the second height B) is longer than a distance that is the first height (H) minus the third height (A) and the depth (D)(that is $B>H-A-D$). Then, a relationship equation between the heights and the depth of the clamping-sliding assembly 30 is defined as: $H-A-D<B<H-A$. Therefore, if the sizes of the components of the track 10 and the clamping-sliding assembly 30 are satisfied the above-mentioned relationship equation, the components of the clamping-sliding assembly 30 can be assembled in the track 10 to prevent the clamping-sliding assembly 30 from turning over the track 10.

Figure 4:
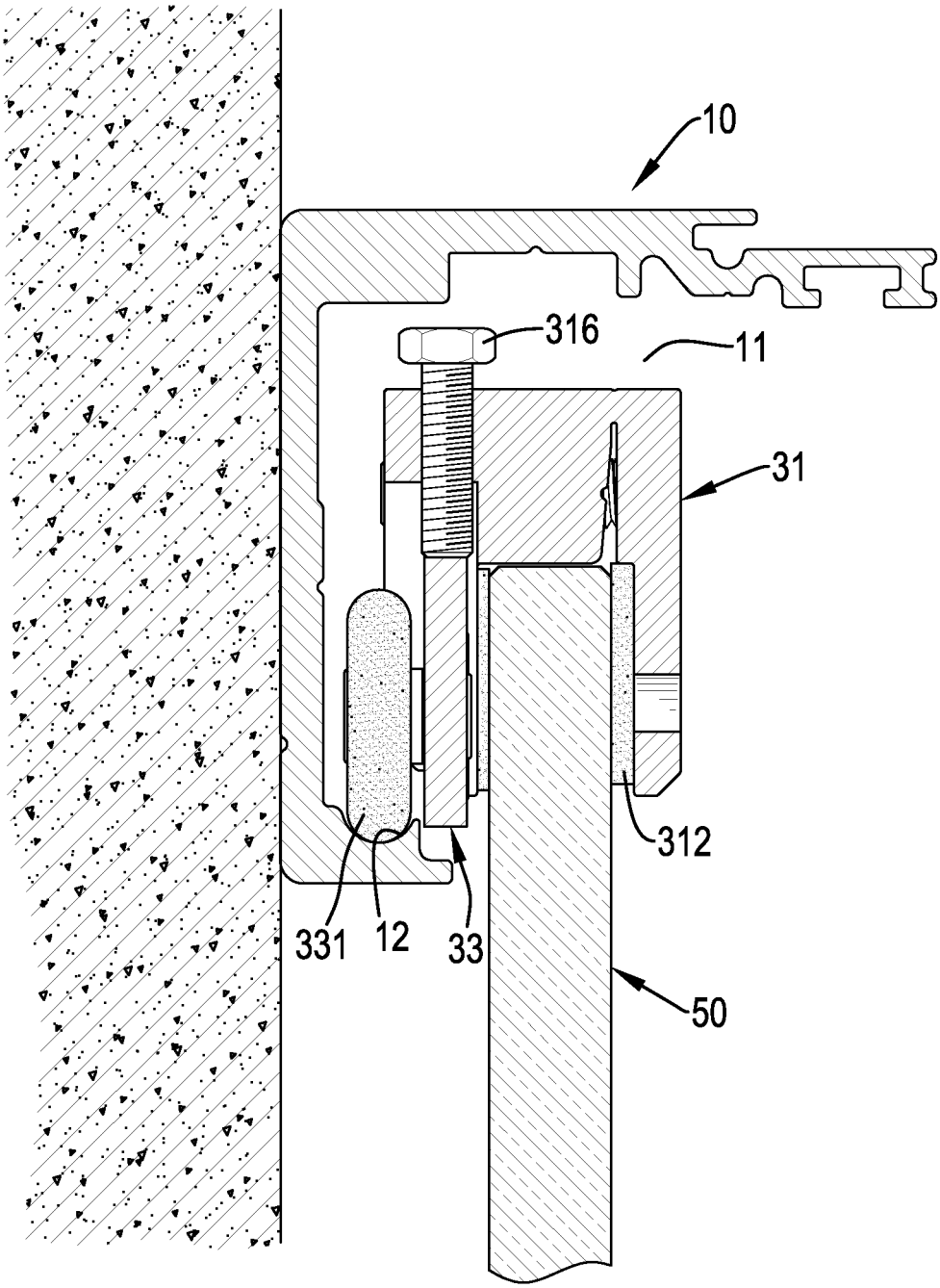
FIG. 4 is a side view in partial section of the clamping-sliding assembly in FIG. 1 mounted on a wall.

When assembling the clamping-sliding assembly in accordance with the present invention on a single-track-suspension sliding door such as a glass door 50, with reference to FIG. 4, the track 10 is mounted securely on a wall and a top of the glass door 50 is moved to the opening 11 of the track 10. Because the sizes of the components of the track 10 and the clamping-sliding assembly 30 are satisfied the above-mentioned relationship equation ($H-A-D<B<H-A$) as shown in FIG. 3, the adjusting bolt 316 will not interfere with the inner top surface of the track 10 and the glass door 50 will not turn over the track 10 after the glass door 50 mounted with the clamping-sliding assembly 30.

Figure 5A:
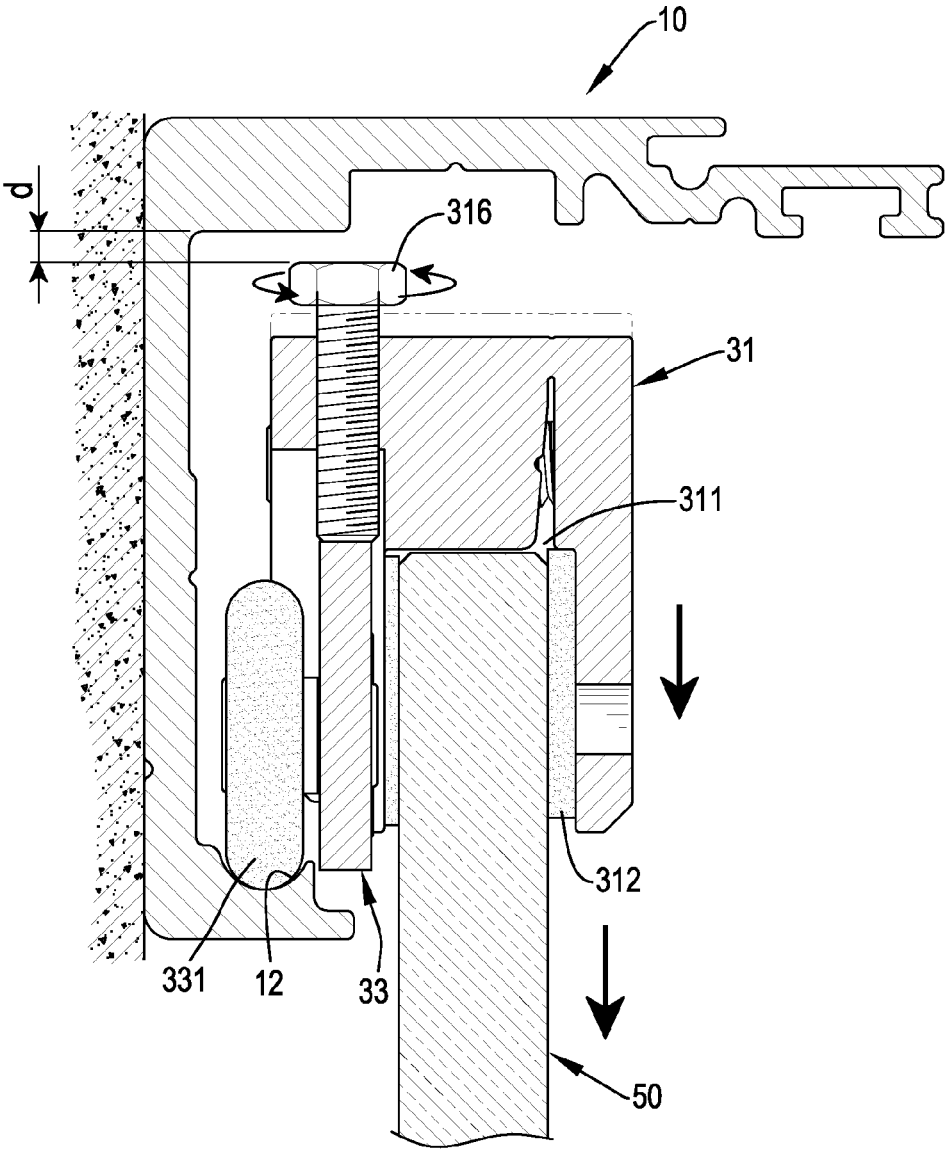
FIG. 5A is an operational side view in partial section of the clamping-sliding assembly in FIG. 1 mounted on a wall.

Furthermore, with referenced to FIGS. 2 and 5A, when the glass door 50 is mounted on the track 10 via the clamping-sliding assembly 30, the height of the glass door 50 relative to the track 10 can be adjusted by rotating the adjusting bolt 316 to move upwardly relative to the body 31 and to press against the abutting face 332 of the roller mount 33. Because the roller mount 33 is mounted in the sliding recess 12 of the track 10 and cannot be moved relative to the track 10, the body 31 will be moved downwardly relative to the roller mount 33 by the connecting mount 315 moving downwardly relative to the adjusting bolt 316. Then, the glass door 50 that is connected securely to the body 31 will be moved downwardly relative to the track 10, and the height of the glass door 50 relative to the track 10 is adjusted.

Figure 5B:
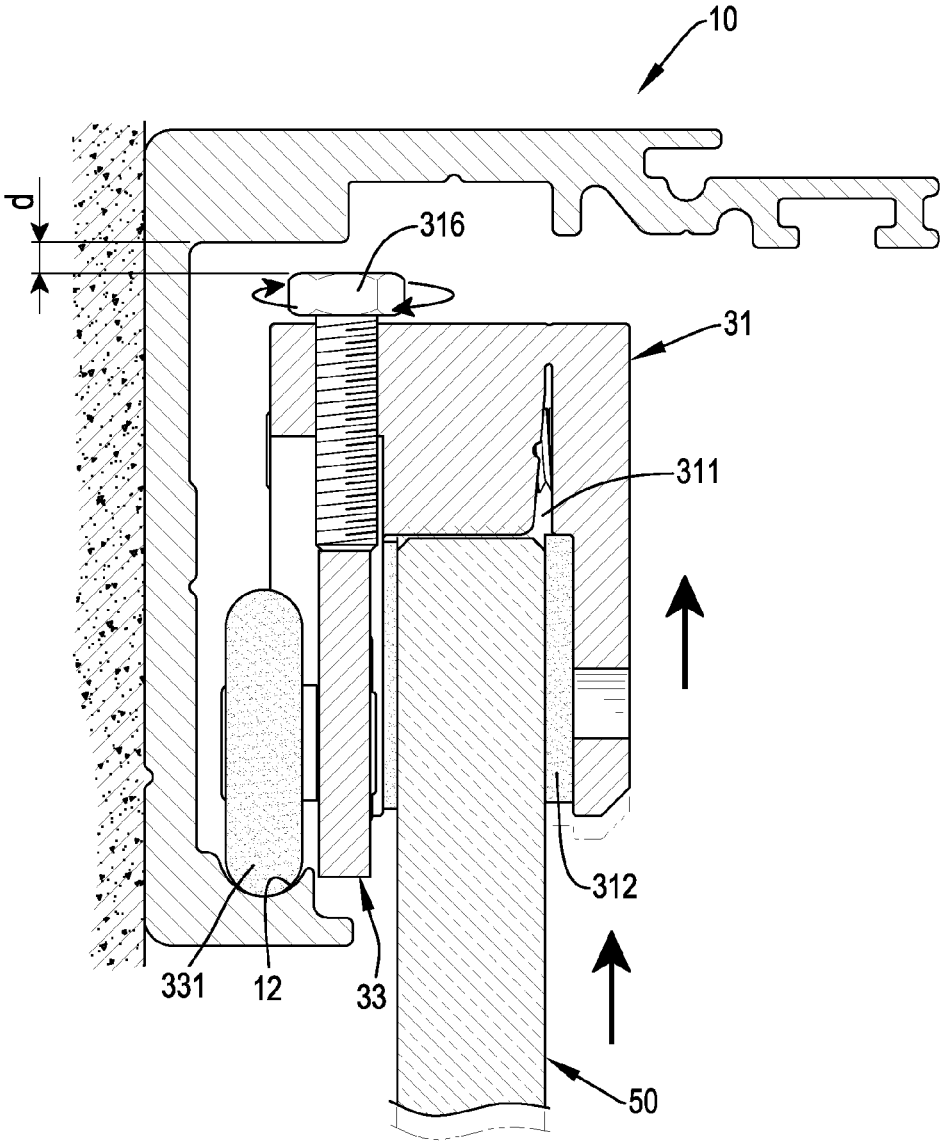
FIG. 5B is another operational side view in partial section of the clamping-sliding assembly in FIG. 1 mounted on a wall.
Figure 6:
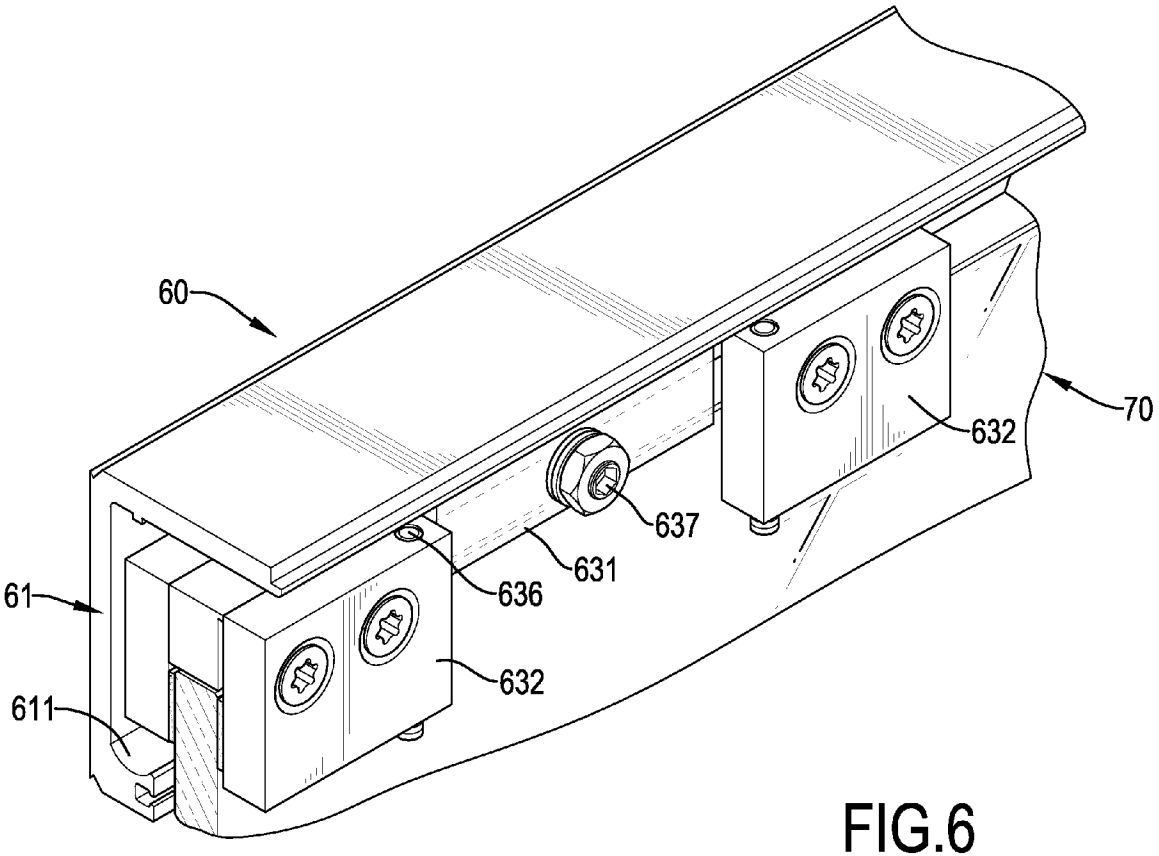
FIG.6 PRIOR ART
FIG. 6 is a perspective view of a clamping-sliding assembly in accordance with the prior art mounted on a single-track-suspension sliding door.
Figure 7:
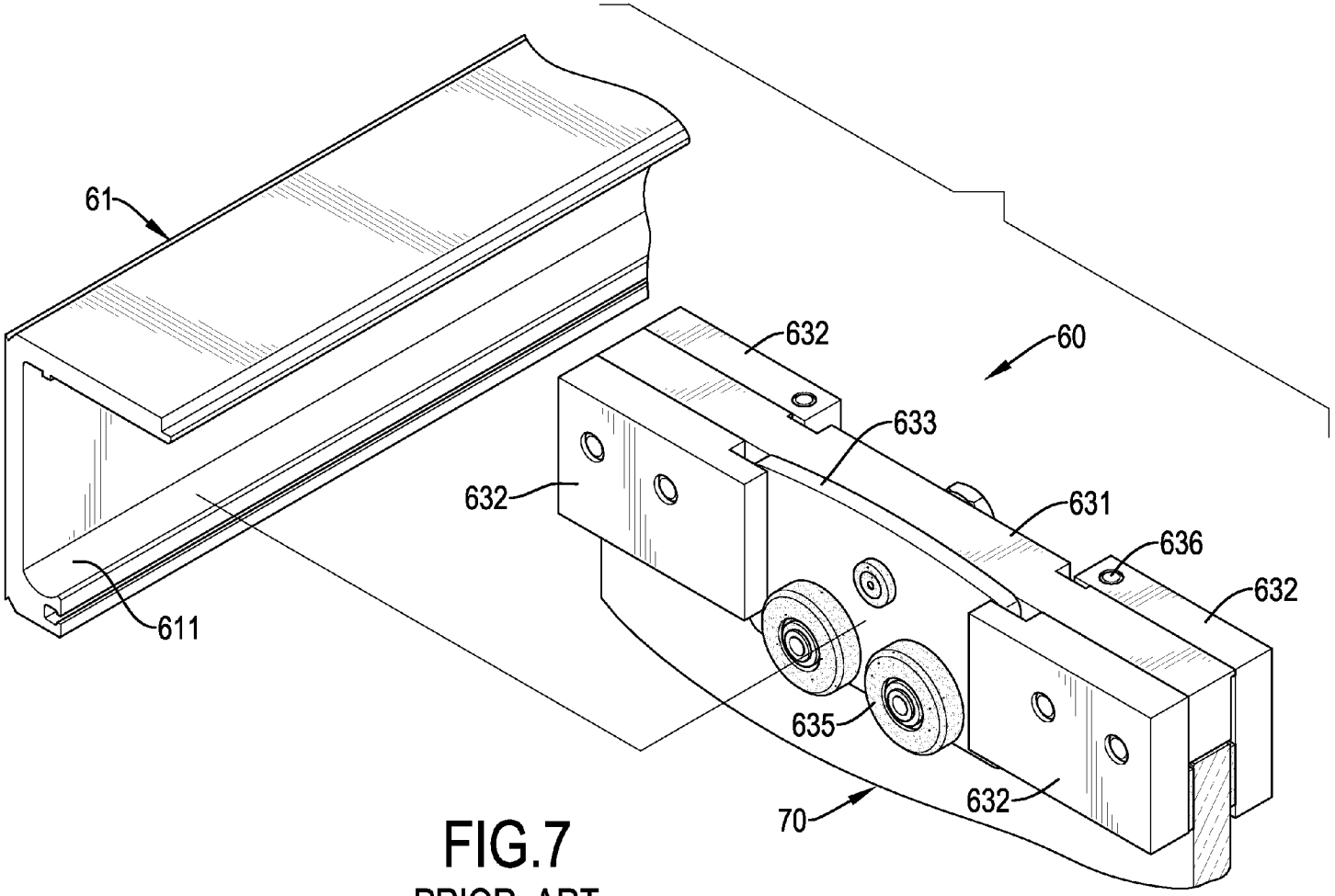
FIG.7 PRIOR ART
FIG. 7 is an exploded perspective view of the clamping-sliding assembly and the track in FIG. 6.
Figure 8:
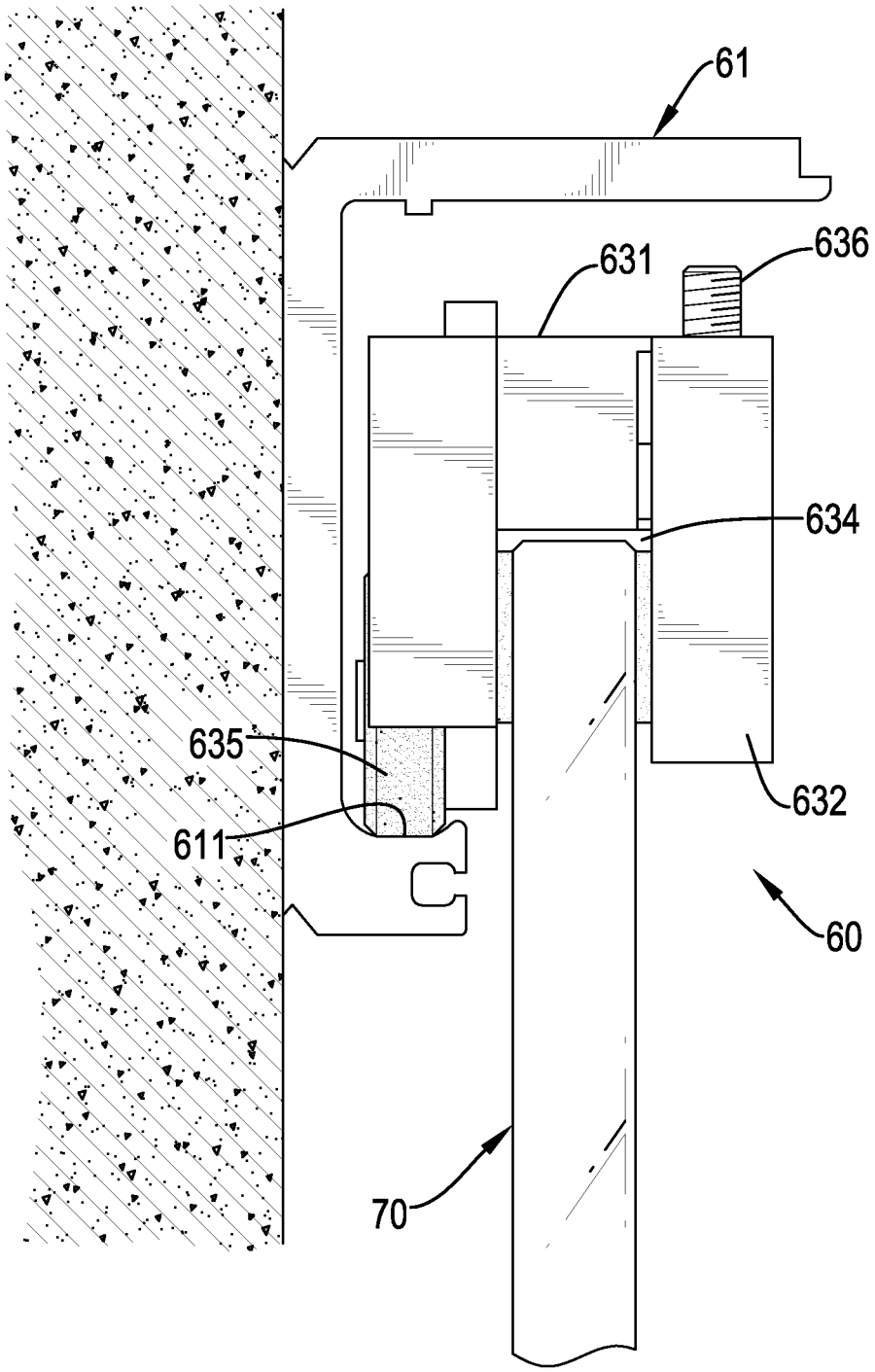
FIG.8 PRIOR ART
FIG. 8 is a side view of the clamping-sliding assembly in FIG. 6 mounted on a wall.

In addition, with reference to FIG. 5B, when the adjusting bolt 316 is rotated in reverse relative to the adjusting bolt 316 in FIG. 5A, the adjusting bolt 316 is moved downwardly relative to the body 31 and to press against the abutting face 332 of the roller mount 33. Because the roller mount 33 is mounted in the sliding recess 12 of the track 10 and cannot be moved relative to the track 10, the body 31 will be moved upwardly relative to the roller mount 33 by the connecting mount 315 moving upwardly relative to the adjusting bolt 316. Then, the glass door 50 that is connected securely to the body 31 will be moved upwardly relative to the track 10, and the height of the glass door 50 relative to the track 10 is adjusted. Furthermore, during the operation of adjusting the height of the glass door 50 relative to the track 10 in FIGS. 5A and 5B, the movable height (d) is a fixe value without changing and this can prevent the adjusting bolt 316 from interfering with the inner top surface of the track 10 during the adjusting process.

According to the above-mentioned, the clamping-sliding assembly 30 for a single-track-suspension sliding door in accordance with the present invention, the sizes (the heights and the depth) of the track 10 and the clamping-sliding assembly 30 have been known in production. When the clamping-sliding assembly 30 is needed to assemble with a track having a different size, the user can change the adjusting bolt 316 with a different size according to the relationship equation ($H-A-D<B<H-A$). Therefore, the user can assemble the glass door 50 with the track 10 via the clamping-sliding assembly 30 according to the relationship equation to prevent the adjusting bolt 316 from interfering with the inner top surface of the track 10 during the assembling process and also can prevent the glass door 50 from turning over the track 10. Therefore, the clamping-sliding assembly 30 can be assembled between the track 10 and glass door 50 to avoid the adjusting bolt 316 to interfere with the track 10 and to prevent the sliding door 50 from turning over the track 10. Furthermore, the user also can adjust the height of the glass door 50 relative to the track 10 by rotating the adjusting bolt 316 relative to the connecting mount 315. Consequently, the adjusting bolt 316 of the body 31 in accordance with the present invention can be used to avoid to interfere with the track 10 and to prevent the sliding door 50 from turning over the track 10.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A clamping-sliding assembly for a single-track-suspension sliding door with a glass door and a track with a sliding recess, and the clamping-sliding assembly mounted between the glass door and the track to prevent the glass door from turning over the track and to adjust a height of the glass door relative to the track and having:

a body having a bottom, a top, an inner side, a middle, a clamping recess transversally formed through the bottom of the body adapted to clamp a top of the glass door, a connecting recess longitudinally formed through the top and the inner side of the body at the middle of the body beside the clamping recess, communicating with the clamping recess and having an inner opening formed through the inner side of the body, a connecting mount formed on and protruding in the connecting recess at the top of the body to extend inwardly to the inner opening of the connecting recess, and the connecting mount having an adjusting hole longitudinally formed through the connecting mount and communicating with the connecting recess, and an adjusting bolt rotatably connected to the connecting mount in the adjusting hole and having a bottom end extending out of the connecting mount and extending in the connecting recess;

a roller mount movably mounted in the connecting recess of the body at the inner side, abutting the adjusting bolt and having a top, a bottom, a middle, an inner side, an outer side, at least one roller rotatably connected to the outer side of the roller mount near the bottom of the roller mount to extend out of the inner side of the body via the inner opening of the connecting recess, and an abutting face formed in the top of the roller mount at the middle of the roller mount and abutting the bottom end of the adjusting bolt for adjusting a height of the roller mount relative to the body;

a distance between a highest point of a movable height of the adjusting bolt and a bottom face of the at least one roller is defined as a first height, a length of the adjusting bolt is defined as a second height, a distance between the abutting face and the bottom face of the at least one roller is defined as a third height, and a depth is defined by the at least one roller that is mounted in the sliding recess; and wherein the second height is shorter than a distance that is formed by the first height minus the third height and is longer than a distance that is formed by the first height minus the third height and the depth to enable the glass door to move smoothly and to prevent the glass door from turning over the track.

2. The clamping-sliding assembly as claimed in claim 1, wherein the body has at least one holding hole transversally formed in the body at the connecting recess and at least one limiting pin mounted securely in the at least one holding hole at the connecting recess near the top of the body; and the roller mount has at least one elongated hole formed through the sides of the roller mount near the top and mounted around the at least one limiting pin.

3. The clamping-sliding assembly as claimed in claim 2, wherein the body has two mats mounted in the clamping recess.

4. The clamping-sliding assembly as claimed in claim 1, wherein the body has two mats mounted in the clamping recess.

5. The clamping-sliding assembly as claimed in claim 4, wherein the body is rectangular U-shaped in cross section.

6. The clamping-sliding assembly as claimed in claim 4, wherein the roller mount has two rollers rotatably connected to the outer side of the roller mount near the bottom of the roller mount.

7. The clamping-sliding assembly as claimed in claim 5, wherein the roller mount has two rollers rotatably connected to the outer side of the roller mount near the bottom of the roller mount.

8. The clamping-sliding assembly as claimed in claim 1, wherein the connecting mount is rectangular.

9. The clamping-sliding assembly as claimed in claim 7, wherein the connecting mount is rectangular.

10. The clamping-sliding assembly as claimed in claim 1, wherein the track is L-shaped in cross section, is mounted securely on a wall and having an inner side, an inner top surface just mounted above the adjusting bolt and the at least one roller, a bottom and an opening formed through the inner side of the track; and the sliding recess is formed in the bottom of the track, communicates with the opening and has a depth.

11. The clamping-sliding assembly as claimed in claim 10, wherein the movable height of the adjusting bolt is defined between a top end of the adjusting bolt and the inner top surface of the track and is a fixed value when the clamping-sliding assembly is mounted between the glass door and the track; and the highest point of the movable height of the adjusting bolt is defined by the inner top surface of the track.

12. The clamping-sliding assembly as claimed in claim 11, wherein the depth of the at least one roller that is mounted in the sliding recess is same as the depth of the sliding recess.

13. The clamping-sliding assembly as claimed in claim 12, wherein the first height is same as a distance between the bottom face of the at least one roller and the inner top surface of the track.

14. The clamping-sliding assembly as claimed in claim 13, wherein the movable height is shorter than the depth that is defined by the at least one roller mounted in the sliding recess.

15. The clamping-sliding assembly as claimed in claim 14, wherein the connecting mount is formed on and protrudes in the connecting recess at a middle of the connecting recess to form two upper openings at the top of the body beside the connecting mount; and the roller mount has two guiding tabs formed on and protruding upwardly from the top of the roller mount beside the abutting face and respectively mounted in the upper openings to prevent the roller mount from tilting relative to the body.

16. The clamping-sliding assembly as claimed in claim 15, wherein the at least one elongated hole of the roller mount is formed through one of the guiding tabs of the roller mount.

* * * * *